US008317044B2

(12) United States Patent
Wu et al.

(10) Patent No.: US 8,317,044 B2
(45) Date of Patent: Nov. 27, 2012

(54) FOOD CONTAINER

(76) Inventors: Shen Xiong Wu, Brooklyn, NY (US); Jian Wen Liang, Brooklyn, NY (US)

( * ) Notice: Subject to any disclaimer, the term of this patent is extended or adjusted under 35 U.S.C. 154(b) by 155 days.

(21) Appl. No.: 12/981,122

(22) Filed: Dec. 29, 2010

(65) Prior Publication Data

US 2012/0168338 A1 Jul. 5, 2012

(51) Int. Cl.
*B65D 6/28* (2006.01)
*B65D 8/18* (2006.01)

(52) U.S. Cl. ..... 220/4.21; 220/782; 206/508

(58) Field of Classification Search ..... 220/4.21, 220/4.26, 781, 782; 206/508
See application file for complete search history.

(56) References Cited

U.S. PATENT DOCUMENTS

| | | | | |
|---|---|---|---|---|
| 4,660,716 | A | 4/1987 | McMahon et al. | |
| 6,056,138 | A | 5/2000 | Chen | |
| 6,196,404 | B1 | 3/2001 | Chen | |
| 6,460,716 | B1 * | 10/2002 | Wong | 220/4.24 |
| 2007/0007297 | A1 * | 1/2007 | Li | 220/782 |
| 2010/0065461 | A1 * | 3/2010 | Chhay | 206/505 |

* cited by examiner

*Primary Examiner* — Harry Grosso
(74) *Attorney, Agent, or Firm* — Law Offices of Albert Wai-Kit Chan, PLLC

(57) ABSTRACT

This invention is directed to a food container comprising a lid and a base. The lid and base form three seals, including a locking seal, to prevent the leakage or spoilage of food during transport or temporary storage. Blades on the lid sealing edge and blades on the base sealing edge strengthen said edges, and further reinforce the seals formed between the lid and base. The lid and base, separately or when assembled, are stably stackable requiring a minimal amount of storage space.

9 Claims, 7 Drawing Sheets

FOOD CONTAINER

BACKGROUND OF INVENTION

Different types of containers, comprising a lid and a base, are used to hold and transport "takeout" food purchased at a restaurant. It is important that such containers are capable of preventing the leakage and/or spoilage of food during transport or temporary storage. Although there are typically seals between the lid and base, the seals are easily broken or disrupted accidentally by movement or handling. Some seals are formed by a planar surface in the lid contacting a planar surface in the base, such as the one disclosed in U.S. Pat. No. 6,196,404. When the planar surface at which a seal is to be formed is a horizontal surface that is part of the base, it is easy for food residue to fall and stay on the surface, causing the seal between the lid and base to be disrupted or broken. This may in turn lead to distortion of the lid, which then causes another adjacent seal, if any, to be broken or disrupted. The seals can also become defective when the high temperature of hot food distorts the shape of the lid or base. Furthermore, the seals may be defective because the lid or base may have been distorted during manufacture, transport or storage under drastic fluctuation in temperature. As a result, the food held by the container, particularly any liquid or sauce, may leak out of the container and loses its freshness or even become spoiled quickly.

SUMMARY OF INVENTION

The present invention provides a food container that addresses the deficiencies of the existing food containers. The present container uses three seals including a locking seal to ensure that seals would not break upon routine manufacture and use, or due to food accumulation around the areas where seals are to be formed. The container can be in any shape, including but not limited to circular, rectangular, square and oval; and the container can have one or more compartments. The container is designed in such a way that the lids or the bases can be stacked together to save space when in storage. Alternatively, two or more containers, when fully assembled, may be stacked together with reduced risk that one would slip off another.

DETAILED DESCRIPTION OF INVENTION

Figure 1:
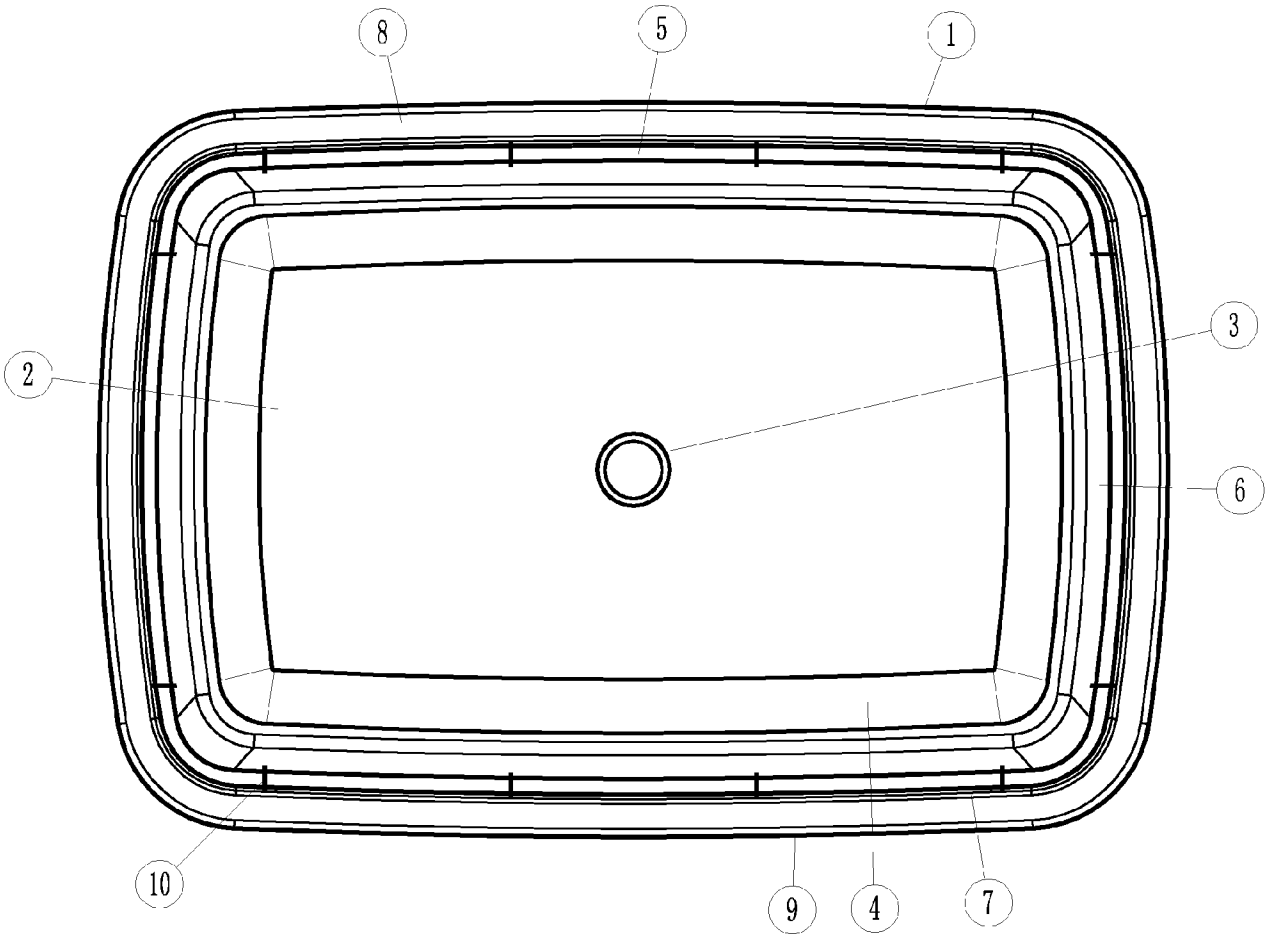
FIG. 1 is an aerial view of a lid as seen from the top.

The present invention provides a food container comprising a lid and base, wherein the seals between the lid and base can form uniformly and tightly even when both may become slightly distorted during manufacture or storage. In contrast to existing food containers commonly used by restaurants for takeout food, the present food container minimizes the possibility of food preventing the seals from forming between the lid and base. The container can be in any shape, including but not limited to circular, rectangular, square and oval; and the container can have one or more compartments.

The present invention provides a container comprising a lid and a base, wherein said lid has:

(a) A substantially planar top portion,
(b) A perimeter wall extending downward from said top portion,
(c) A rim extending substantially horizontally outward from said wall,
(d) A sealing edge attached to said rim, and
(e) Blades attached to said edge;

and said base has:

(a) A substantially planar bottom portion,
(b) A perimeter wall extending upward from said bottom portion,
(c) A lower rim extending substantially horizontally outward from said base wall,
(d) An upper wall extending upward from said lower rim,
(e) An upper rim extending outward from said upper wall, and
(f) A sealing edge attached to said upper rim;

wherein said lid sealing edge and base sealing edge are molded to be mateable to each other and, upon mating, said lid sealing edge and said base sealing edge form three seals, wherein said blades push said base sealing edge against said lid sealing edge.

In one embodiment, the planar top portion of the lid has a semicircular channel close to the edges of said planar top portion. In an embodiment, the planar top portion has an indent in the middle, wherein said indent optionally has a hole in the middle. In another embodiment, the planar bottom portion of the base has a semicircular channel around the edges of said planar bottom portion.

In one embodiment, the lid sealing edge further comprises:

(a) An inner edge extending upward from the lid rim,
(b) A middle edge extending substantially horizontally and outward from said inner edge, and having a protrusion running longitudinally along said middle edge and around said lid,
(c) Blades connecting said inner edge and said middle edge, and
(d) An outer edge extending downward from said middle edge, and having a channel running longitudinally along the inner side of said outer edge and around said lid, and a protrusion immediately below said channel and running around said lid.

In one embodiment, the base sealing edge further comprises:

(a) An inner edge extending upward from the upper rim,
(b) A middle edge extending substantially horizontally and outward from said base inner edge,
(c) Blades connecting said base inner edge and said base middle edge, and
(d) An outer edge extending downward from said base middle edge and ending with a protrusion;

wherein upon mating of said lid and said base, said channel on said lid outer edge forms a locking seal with said protrusion on said base outer edge, said lid outer edge forms a second seal with said base outer edge, and said protrusion on said lid middle edge forms a third seal with said base middle edge.

In one embodiment, the engagement of the locking seal urges the engagement of the second and third seal.

In one embodiment, more than one lid may be stacked within one another, more than one base may be stacked within one another, and more than one container may be stacked on top of one another in a secure manner.

The present invention also provides a container comprising a lid and a base, wherein said lid has:

(a) A substantially planar top portion,
(b) A perimeter wall extending downward from said top portion,
(c) A rim extending substantially horizontally outward from said wall, and
(d) A sealing edge comprising
  (i) An inner edge extending upward from said lid rim,
  (ii) A middle edge extending substantially horizontally and outward from said inner edge, and having a protrusion running longitudinally along said middle edge and around said lid,
  (iii) Blades connecting said inner edge and said middle edge, and
  (iv) An outer edge extending downward from said middle edge, and having a channel running longitudinally along the inner side of said outer edge and around said lid, and a protrusion immediately below said channel and running around said lid;

and said base has:

(a) A substantially planar bottom portion,
(b) A perimeter wall extending upward from said bottom portion,
(c) A lower rim extending substantially horizontally outward from said base wall,
(d) An upper wall extending upward from said lower rim,
(e) An upper rim extending outward from said upper wall, and
(f) A sealing edge comprising
  (i) An inner edge extending upward from said upper rim,
  (ii) A middle edge extending substantially horizontally and outward from said base inner edge,
  (iii) Blades connecting said base inner edge and said base middle edge, and
  (iv) An outer edge extending downward from said base middle edge and ending with a protrusion;

wherein said lid sealing edge and said base sealing edge are molded to be mateable to each other and, upon mating, the channel on said lid outer edge forms a locking seal with the protrusion on said base outer edge, the lid outer edge forms a second seal with the base outer edge, and the protrusion on said lid middle edge forms a third seal with said base middle edge, wherein the engagement of said locking seal urges the engagement of said second and third seal.

In one embodiment, the planar top portion of the lid has a semicircular channel close to the edges of the planar top portion. In another embodiment, the planar top portion of the lid has an indent in the middle, wherein said indent optionally has a hole in the middle.

In one embodiment, the planar bottom portion of the base has a semicircular channel around the edges of said planar bottom portion. In another embodiment, the lid further comprises blades connecting the lower part of the lid perimeter wall with the lid inner edge.

In one embodiment, the base further comprises blades connecting the base inner edge with the base middle edge. In another embodiment, more than one lid may be stacked within one another, more than one base may be stacked within one another, and more than one container may be stacked on top of one another in a secure manner.

Figure 2:
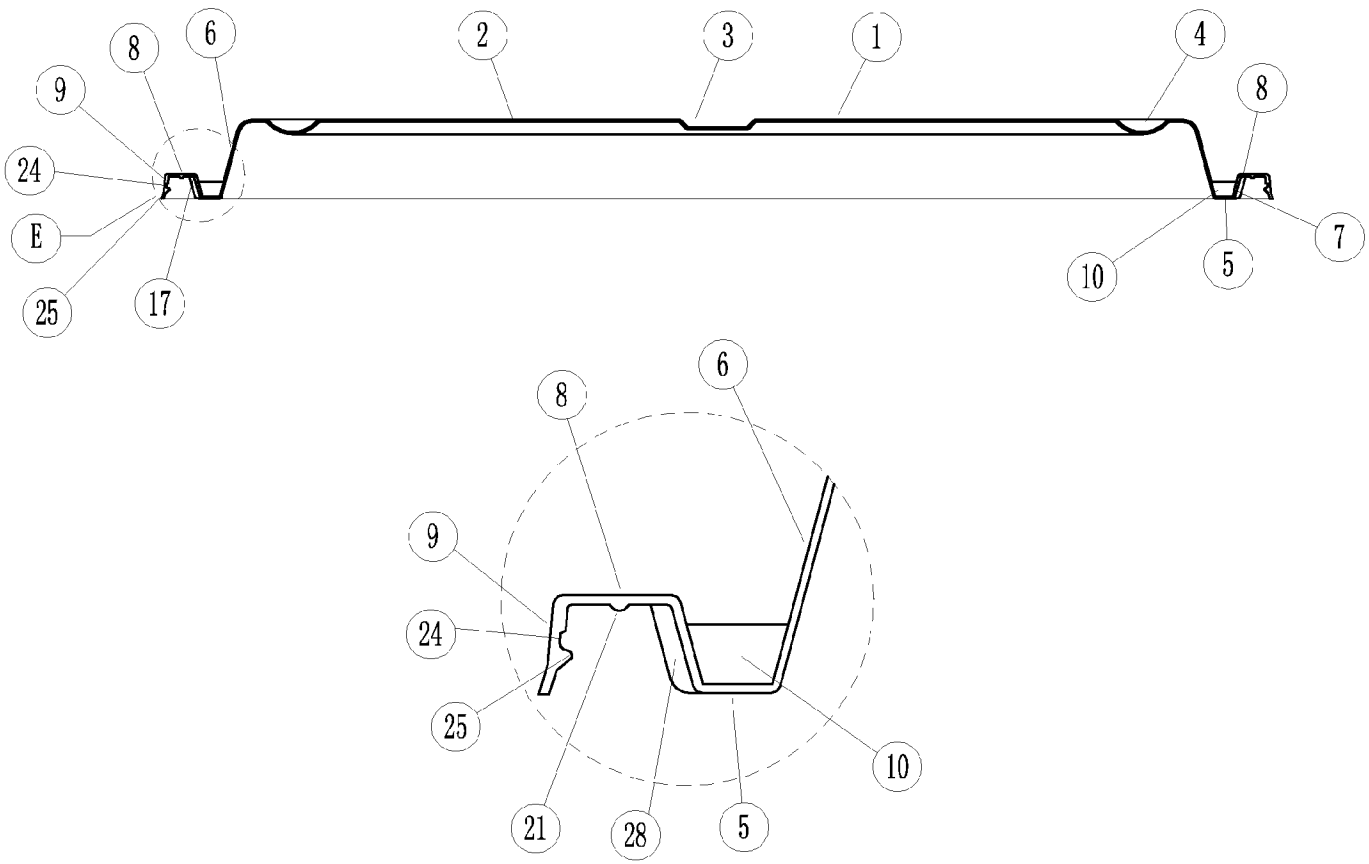
FIG. 2 is a cross-sectional view of a lid and an enlarged view of the rim and edges.

FIG. 1 shows an embodiment of a lid of the present invention as viewed from the top, and FIG. 2 shows a cross-sectional view of the lid. The lid has a substantially planar top portion 2. In the middle of 2 is a small indent which may be round or some other shape having optionally a small hole in the middle to allow hot air or vapor to escape. Close to the edges of the top portion 2 is a semicircular channel 4 running along the four sides of the top portion. A perimeter wall 6 extends substantially vertically, or at a small angle to a vertical line, downward from the top portion 2. A rim 5 extends substantially horizontally outward from the perimeter wall 6. An inner edge 7 (see enlarged view in FIG. 2) extends generally perpendicularly, or at a small angle to a vertical line, upward from rim 5. A middle edge 8 is connected substantially horizontally to the inner edge 7. An outer edge 9 extends generally downward from the edge 8, such that 7, 8 and 9 together resemble a trapezoid without the longer of the two parallel sides. Spaced along the rim 5 are blades 10 connecting the lower part of the perimeter wall 6 with the lower part of inner edge 7. The protrusions provide strength to the inner edge which may otherwise be easily distorted upon storage or handling. Joining inner edge 7 and middle edge 8 are blades 28 spaced along inner edge 7. These blades provide strength to the two edges to avoid distortion, and reinforce the seals formed between the lid and base. On the underside of edge 8 is a protrusion 21 running longitudinally along the edge 8 and around the lid. The protrusion serves to provide a seal when the lid is coupled with a base. The inner side of edge 9 has a channel 24 running longitudinally along the edge 9 and around the lid. A locking lip 25 protrudes from edge 9 immediately below and along channel 24. The channel is to be mated with a protrusion on the base to form a locking seal.

Figure 3:
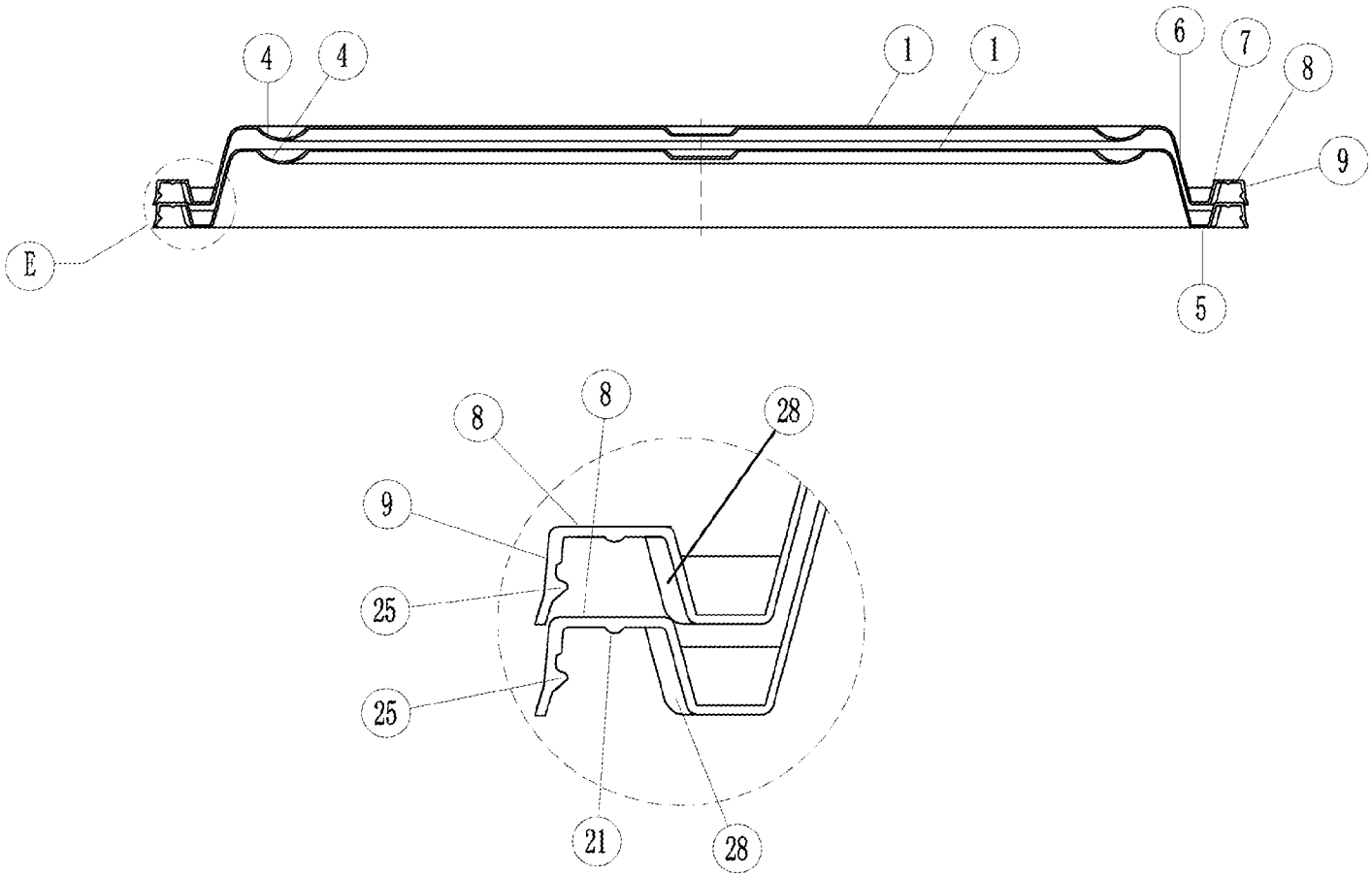
FIG. 3 is a cross-sectional view of two lids stacked together and an enlarged view of the rims and edges when stacked together.

FIG. 3 shows the stacking of two lids. Blade 28 and outer edge 9 of one lid rest securely on both sides of the middle edge of another lid. At the same time, the planar top portion of the first lid rests on top of that of the second lid. In this way, a number of lids can be stacked together using minimal amount of storage space.

Figure 4:
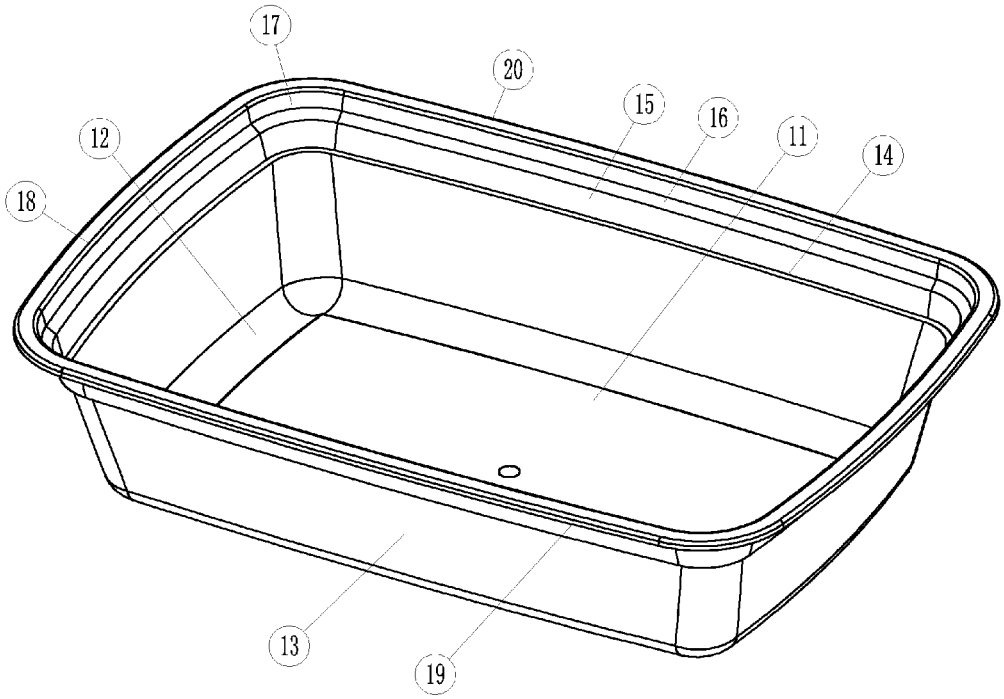
FIG. 4 is an aerial perspective and cross-sectional view of a base.
Figure 4:
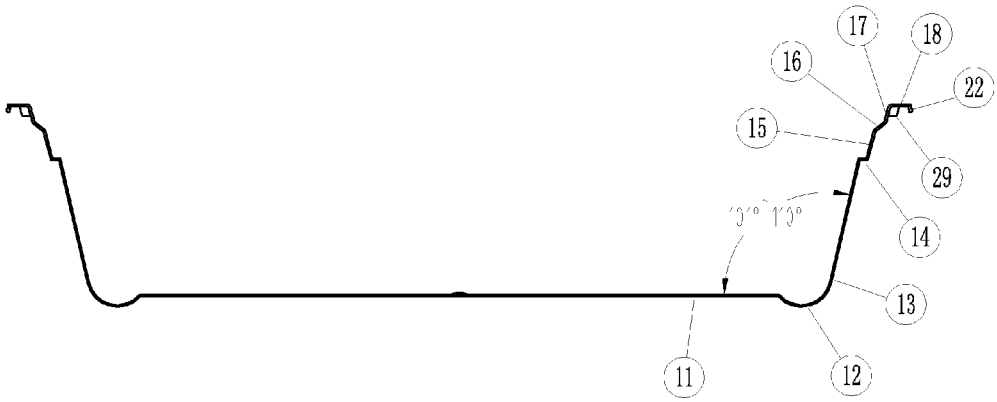

FIG. 4 shows an aerial perspective and cross-sectional view of an embodiment of a base of the present invention. The base has a substantially planar bottom portion 11. Surrounding the bottom portion is a semicircular channel 12 which is joined by a perimeter wall 13 extending upward, substantially vertically or at a small angle to a vertical line. The small angle is preferably 11-20°. The perimeter wall ends in a horizontally extending rim 14 (see also FIG. 5) which provides strength to said wall. Rim 14 is integrally connected to an upper wall 15 which extends upward and substantially parallel to perimeter wall 13. Extending outward from 15 and at an angle, preferably 20-70°, from a horizontal line is rim 16. Extending upward from rim 16 and substantially parallel to upper wall 15 is an inner edge 17, from which extends substantially horizontally and outwardly a middle edge 18. An outer edge 22 extends substantially downward from the middle edge and ends with a protrusion 26 which mates perfectly with the locking lip 25 in the lid to form a locking seal. Spaced along and connecting edges 17 and 18 are blades 29 which provide strength to the edges so that the angles between them would be kept intact even when the bases are stacked together.

Figure 5:
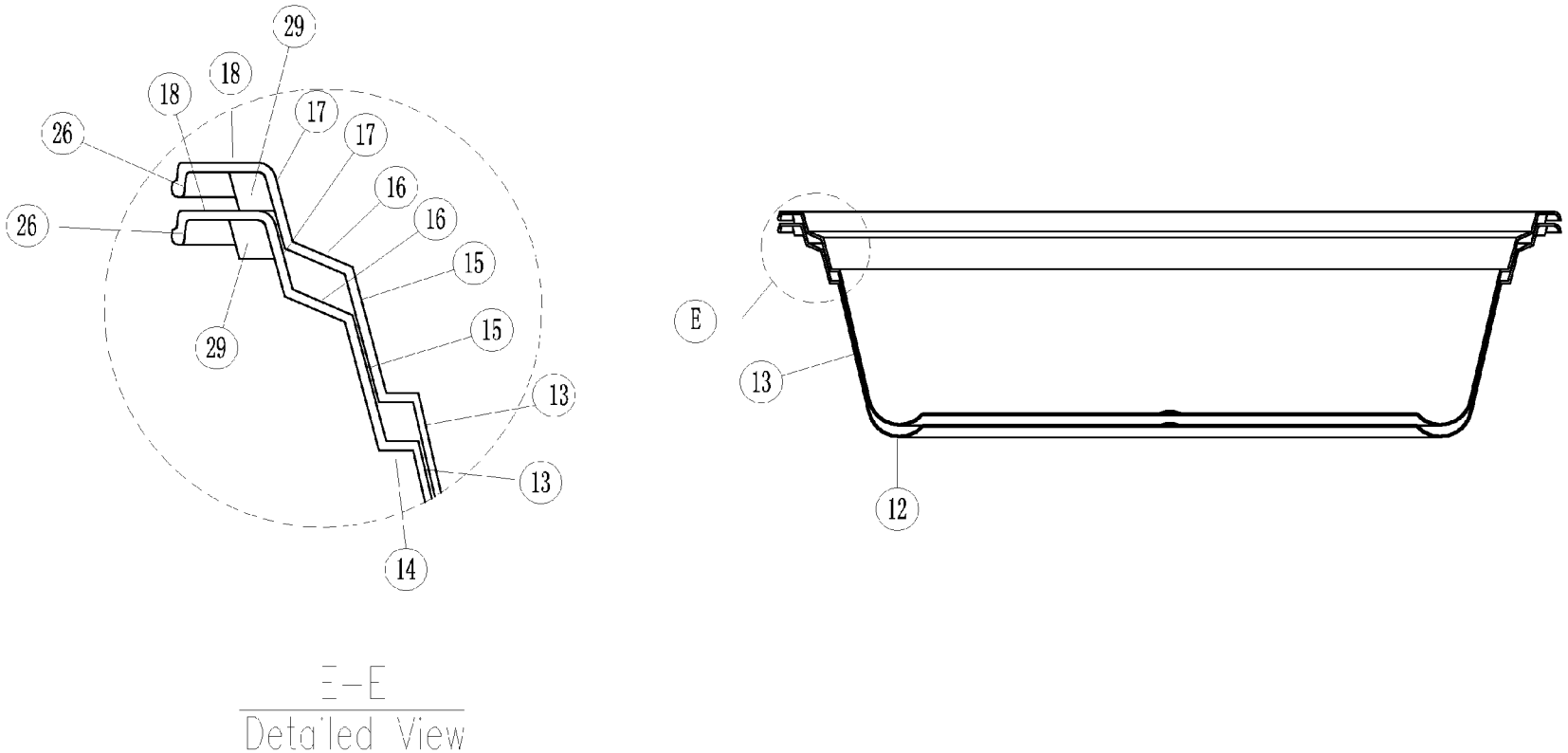
FIG. 5 is a cross-sectional view of two bases stacked together and an enlarged view of the rims and edges when stacked together.

FIG. 5 shows the stacking of two bases. Blade 29 of one base rests securely on the middle edge 18 of another base so that the planar bottom portion of the first base fits snugly over the planar bottom portion of the second base. In this way, many bases can be stacked together securely using minimal storage space.

Figure 6:
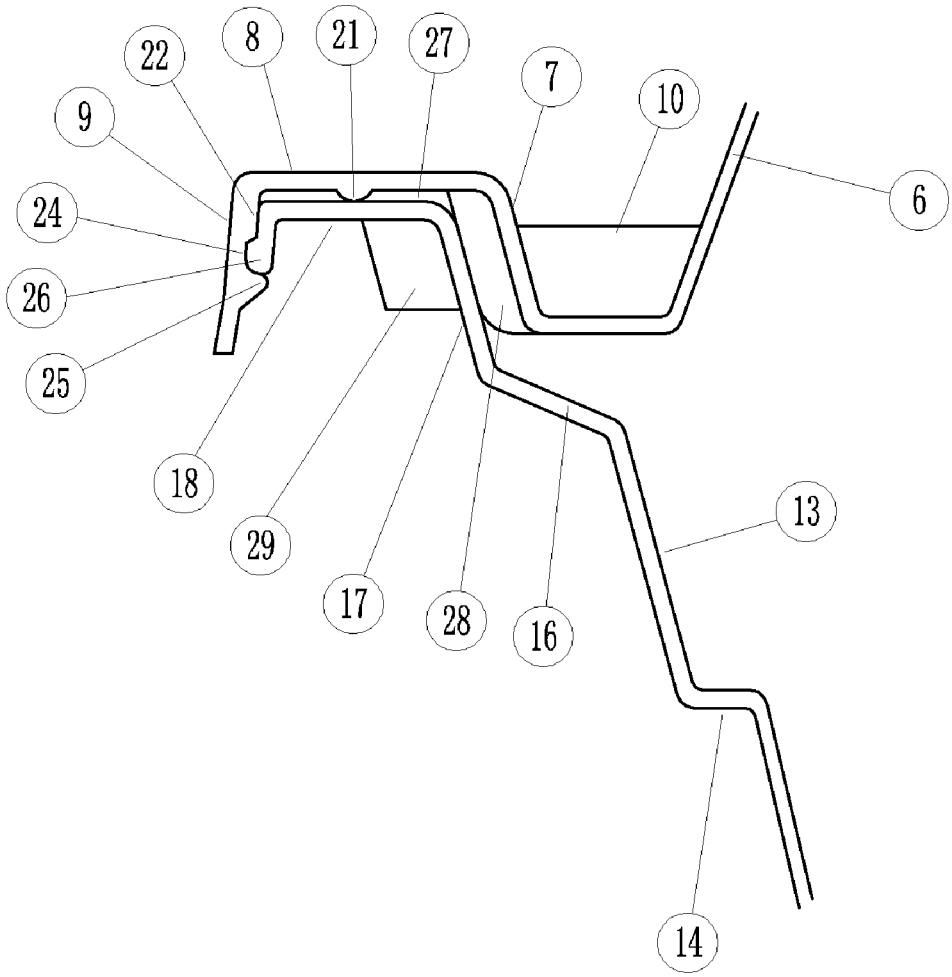
FIG. 6 shows parts of a lid and base where seals are formed.
Figure 7:
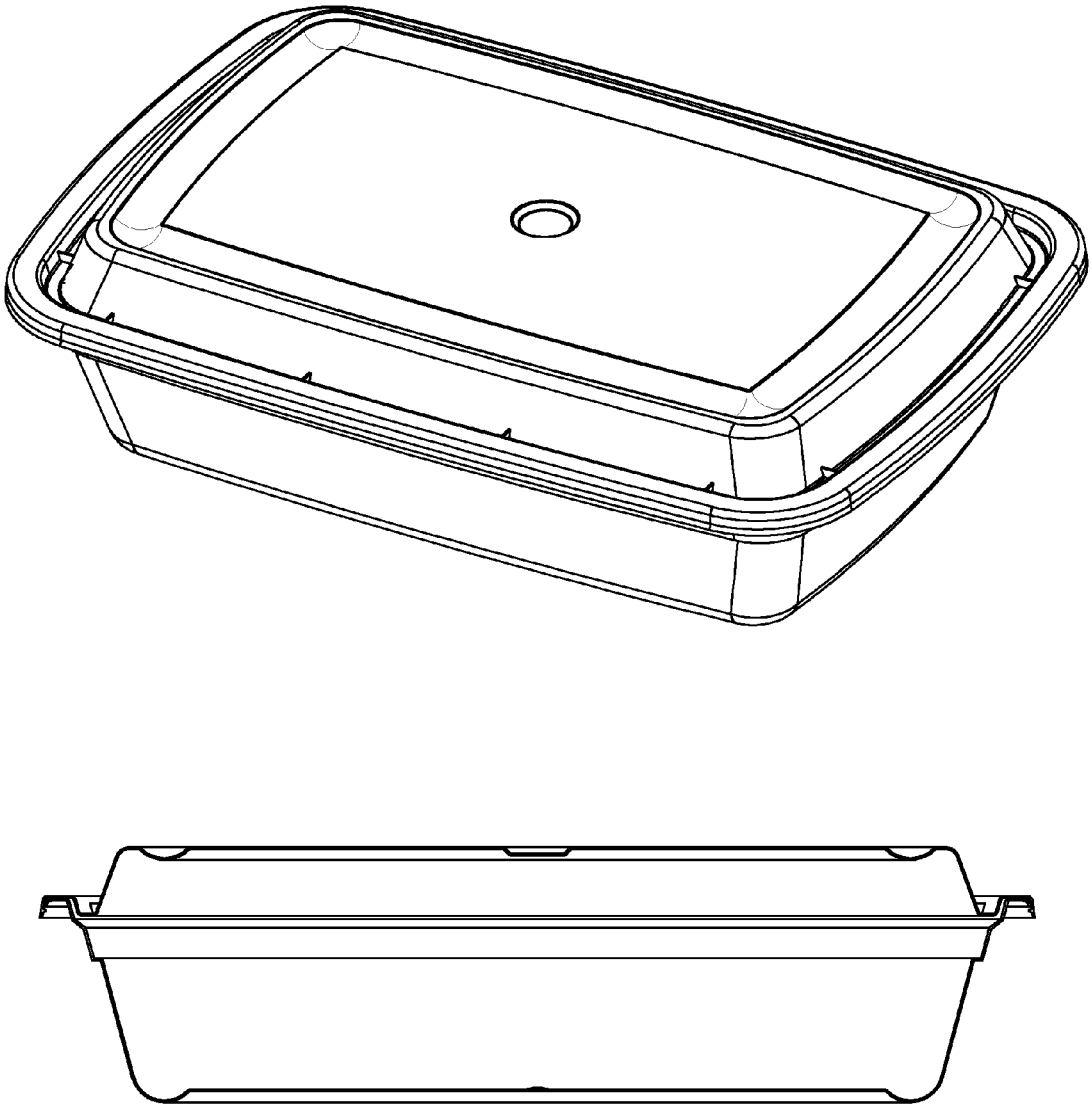
FIG. 7 is an aerial perspective and cross-sectional view of a container when fully assembled.

FIG. 6 shows how the different components of the lid and base work together to provide tight seals when the lid and base are coupled to produce a fully assembled container as indicated in FIG. 7, which shows an aerial perspective and cross-sectional view of a fully assembled container. When more than one container are fully assembled, the channel 12 of one base can rest in the channel 4 in the top portion of a lid so that a number of containers may stack together without the risk of one slipping off another, unlike some existing food containers.

To assemble a container of the present invention, the outer edge of a lid is lined up with the outer edge of a base (see FIG. 6). The lid is then pressed in a downward motion onto the base. The downward motion is guided by the blade 28 until the locking lip 25 in the lid contacts the protrusion 26 in the base outer edge, whereupon the locking lip flexes the lid outer edge 9 outward. Upon further downward pressure, protrusion 26 moves past the locking lip and becomes mated to channel 24 in the lid to form a locking seal, wherein part of the inner flat surface of edge 9 forms a second seal with the outer flat surface of edge 22. These seals cannot be broken without an outward pulling force applied onto the lid outer edge. They also urge the formation of a third seal between protrusion 21 in the lid and the middle edge 18 of the base. The three seals reinforce one another and are further reinforced by blade 28 which applies a force to the inner and outer edge of the base so that they will be kept in place. This in turn maintains the tight seal between 18 and protrusion 21. Because the contact area between 18 and 21 is small compared with that between two flat surfaces, as in some existing food containers, the seal between 18 and 21 is very tight and effective in keeping any liquid or air from seeping through the seal. Furthermore, because rim 16 in the base is not horizontal, in contrast to some existing food containers, the chance that food residue will stay on 16 and prevent a tight seal between the lid and base is drastically reduced. So is the chance for any liquid or sauce, which would tend to flow back to the bottom of the base, to reach the seal between 18 and 21.

Therefore, the locking seal, the seal between 9 and 22, and the seal between 21 and 18 are all mutually reinforcing. Blade 28 further reinforces these seals, and keeps the lid and base in a locked position. The seals can be intentionally broken by pulling the outer edge 9 of the lid outward and then upward to release the locking seal first, followed by the other seals.

While the invention has been described with reference to preferred embodiments, it should be appreciated by those skilled in the art that the invention may be practiced in embodiments different from those specifically described without departing from the scope of the invention.

Throughout this application, various references or publications are cited. Disclosures of these references or publications in their entireties are hereby incorporated by reference into this application in order to more fully describe the state of the art to which this invention pertains. It is to be noted that the transitional term "comprising", which is synonymous with "including", "containing" or "characterized by", is inclusive or open-ended, and does not exclude additional, un-recited elements or method steps.

What is claimed is:

1. A container comprising a lid and a base, wherein said lid has:

(a) A substantially planar top portion, (b) A perimeter wall extending downward from said top portion, (c) A rim extending substantially horizontally outward from said wall, (d) A sealing edge comprising:

(i) An inner edge extending upward from said lid rim, (ii) A middle edge extending substantially horizontally and outward from said inner edge, and having a protrusion running longitudinally along said middle edge and around said lid, (iii) Blades connecting said inner edge and said middle edge, and (iv) An outer edge extending downward from said middle edge, and having a channel running longitudinally along the inner side of said outer edge and around said lid, and a protrusion immediately below said channel and running around said lid;

and said base has:

(a) A substantially planar bottom portion, (b) A perimeter wall extending upward from said bottom portion, (c) A lower rim extending substantially horizontally outward from said base wall, (d) An upper wall extending upward from said lower rim, (e) An upper rim extending outward from said upper wall, (f) A sealing edge comprising:

(i) An inner edge extending upward from said upper rim, (ii) A middle edge extending substantially horizontally and outward from said base inner edge, (iii) Blades connecting said base inner edge and said base middle edge, and (iv) An outer edge extending downward from said base middle edge and ending with a protrusion;

wherein said lid sealing edge and said base sealing edge are molded to be mateable to each other and, upon mating, the channel on said lid outer edge forms a locking seal with the protrusion on said base outer edge, the lid outer edge forms a second seal with the base outer edge, and the protrusion on said lid middle edge forms a third seal with said base middle edge, wherein the engagement of said locking seal urges the engagement of said second and third seal.

2. The container of claim 1, wherein said planar top portion has a semicircular channel close to the edges of said planar top portion.

3. The container of claim 1, wherein said planar top portion has an indent in the middle, wherein said indent optionally has a hole in the middle.

4. The container of claim 1, wherein said planar bottom portion has a semicircular channel around the edges of said planar bottom portion.

5. The container of claim 1, further comprising blades connecting the lower part of the lid perimeter wall with the lid inner edge.

6. The container of claim 1, further comprising blades connecting the base inner edge with the base middle edge.

7. The container of claim 1, wherein more than one said lid may be stacked within one another.

8. The container of claim 1, wherein more than one said base may be stacked within one another.

9. The container of claim 1, wherein more than one said container may be stacked on top of one another.

* * * * *